US006189590B1

(12) United States Patent
Tsay

(10) Patent No.: US 6,189,590 B1
(45) Date of Patent: Feb. 20, 2001

(54) DISK LABEL STICKING DEVICE

(76) Inventor: Wen-Feng Tsay, P.O. Box 24-108, Taipei (TW)

( * ) Notice: Under 35 U.S.C. 154(b), the term of this patent shall be extended for 0 days.

(21) Appl. No.: 09/326,469

(22) Filed: Jun. 7, 1999

(30) Foreign Application Priority Data

Jun. 18, 1998 (TW) ..... 87209771

(51) Int. Cl.[7] ..... B30B 15/00
(52) U.S. Cl. ..... 156/581; 156/580; 100/295
(58) Field of Search ..... 156/580, 581, 156/583.1, 583.3; 100/295

(56) References Cited

U.S. PATENT DOCUMENTS 5,525,187 * 6/1996 Pascal et al. ..... 156/515
5,593,711 * 1/1997 Glaesener ..... 425/595
5,597,440 * 1/1997 Pecha ..... 156/351

* cited by examiner

*Primary Examiner*—James Sells

(57) ABSTRACT

An improved disk label sticking device includes an annular label bearing seat configured to have a lower side pressing against elastic elements on a movable base below. The edges of the label-bearing seat are formed with guide flanges extending into slanting guide slots of a base. Furthermore, the label-bearing seat is centrally provided with a circular through hole having guide slots or guide tracks on its edges. A circular receiving seat has a guide track or guide groove that matches the circular through hole and presses against a central elastic element on the lower base. The receiving seat can be slidably inserted into the through hole. An adhesive-backed annular label can be placed reversely on the label-bearing seat, and a compact disk or an optical disk can be placed reversely on the receiving seat. When the receiving seat is pressed to displace downwardly, the disk will adhere to the label. The label-bearing seat can further be brought to rotate along the slanting guide slots to press the label flat so that the label can adhere to the disk flatly and evenly. The receiving seat can also be temporarily secured within the through hole to reduce the overall size of the device for packaging and storage purposes.

4 Claims, 3 Drawing Sheets

DISK LABEL STICKING DEVICE

BACKGROUND OF THE INVENTION (a) Field of the Invention

The present invention relates to an improved disk label sticking device, and more particularly to a disk sticking device in which a label can be flatly and evenly adhered to a compact disk or optical disk, and in which the overall size of the device can be reduced to facilitate packaging, storage, and transportation.

(b) Description of the Prior Art

Electronic recording devices and data carriers, such as compact disks and optical disks are widely used today. These disks generally have an annular label adhered to a back side thereof. The label is printed by using a printing machine or a printer, and is adhered to the disk by hand or using a label-sticking device. If the label is adhered by hand, the disk may be accidentally damaged, and the efficiency is poor. Besides, the label cannot be adhered flatly or evenly to the disk. In using a label sticker device, an adhesive backed label is placed reversely on a fixed label-bearing seat, and a disk is placed reversely on a receiving seat. By pressing the receiving seat downwardly, the disk is caused to adhere to the label. When pressure is released, and the receiving seat is pushed upward by an elastic force, the disk can then be removed. However, since the label is not always placed flat, and the disk may deviate when the receiving seat displaces downwardly, the label adhered to the disk may not be even and flat. Oftentimes, the worker has to press or spread the label evenly by hand, which is inefficient.

SUMMARY OF THE INVENTION

A primary object of the present invention is to provide an improved disk label sticking device whereby a label can be adhered to a compact disk or optical disk in a flat and even manner. According to this object, the present invention comprises a base, a label bearing seat, and a receiving seat. The base includes an upper cover and a lower base. The lower base is provided with annular seats at suitable positions for receiving elastic elements. The label-bearing seat is centrally provided with a circular through hole for receiving an annular label. The receiving seat is placed inside the circular through hole of the label-bearing seat. It has a bottom side thereof pressing against a central elastic element disposed below, and a top side provided with a securing portion for receiving a central insert hole of a compact or optical disk. The upper cover of the base is centrally formed with a through hole that has partition plates formed at side edges thereof. The lower base is provided with projecting partition pieces that define slanting guide slots with the partition plates of the upper cover. The label bearing seat is fitted in the through hole of the upper cover and has a lower side pressing against the elastic elements on the lower base. The label-bearing seat further has side edges formed with guide flanges that extend into the slanting guide slots of the base, and a bottom portion that defines a suitable clearance with the lower base. An adhesive-backed annular label can be placed reversely on the label-bearing seat, and a compact disk or an optical disk can be placed reversely on the receiving seat. When the receiving seat is pressed to displace downwardly, the disk will adhere to the label. The label-bearing seat can further be brought to rotate along the slanting guide slots to press the label flat so that the label can adhere to the disk flatly and evenly.

Another object of the present invention is to provide an improved disk label-sticking device the size of which can be reduced to facilitate packaging, storage and transportation. According to this object, the receiving seat can be pressed downwardly so that it is temporarily retained within the through hole of the label bearing seat by guide slots or guide tracks of the label bearing seat due to an upward urging force of the elastic element below.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
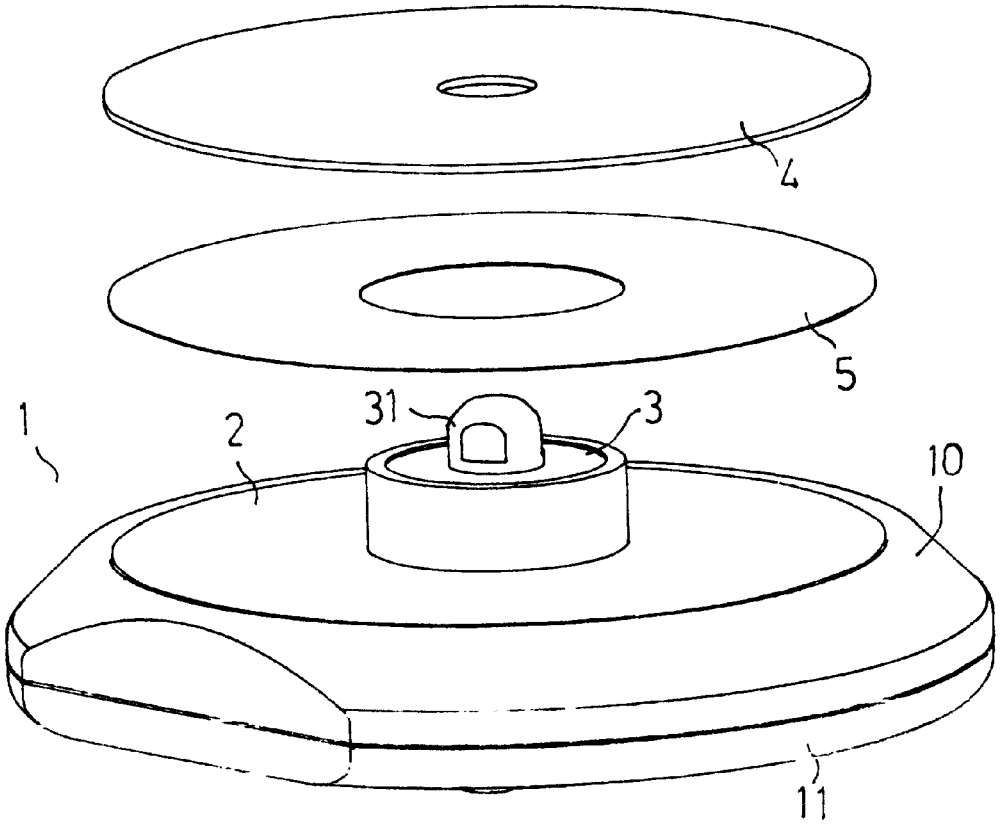
FIG. 1 is a perspective view of the present invention.
Figure 2:
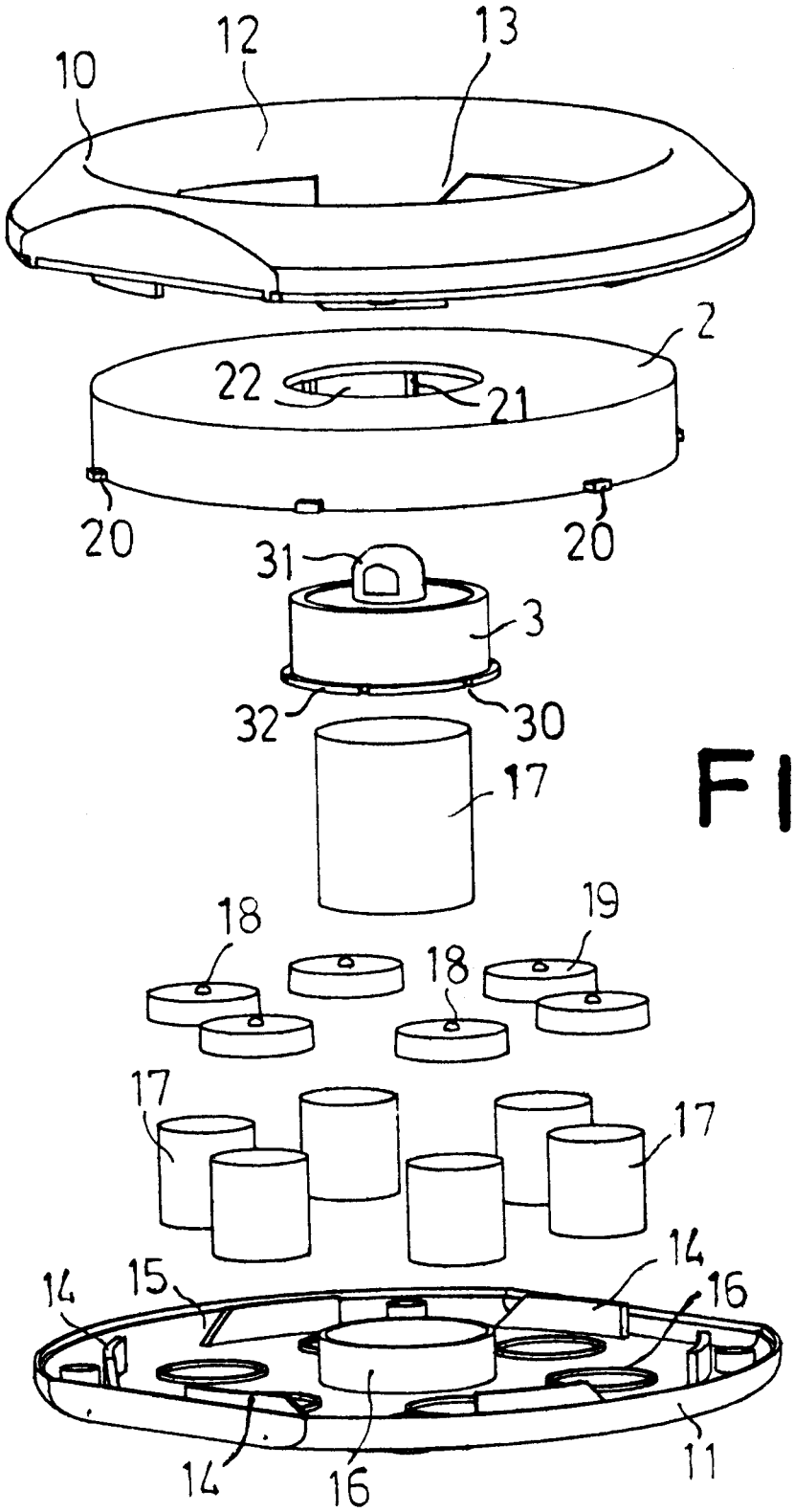
FIG. 2 is a perspective exploded view of the present invention.
Figure 3:
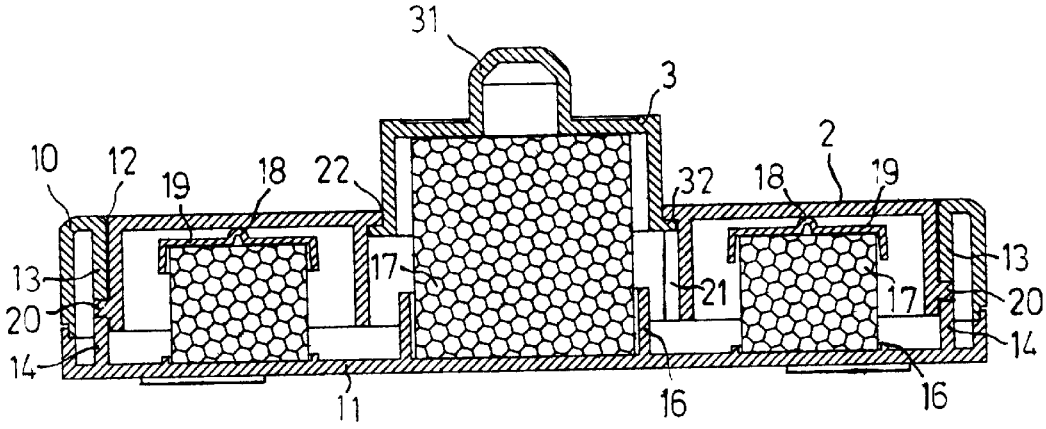
FIG. 3 is a sectional view of the present invention.

With reference to the drawings, the present invention essentially comprises a base 1, a label bearing seat 2 and a receiving seat 3. The base 1 includes an upper cover 10 and a lower base 11. The upper cover 10 is centrally formed with a through hole 12 that has a side edge provided with partition plates 13. The lower base 11 is provided with projecting partition pieces 14. The partition plates 13 and the partition pieces 14 together define slanting guide slots 15. The lower base 11 is further provided with annular seats 16 at suitable positions for receiving elastic elements 17 respectively, which, as shown in thee drawings, are sponges. If necessary, an upper side of each elastic element 17 may be fitted with a cap 19 having a boss 18 so as to reduce the resistance during rotation of the label bearing seat 2. The label-bearing seat 2 is disposed in the upper cover 10, with a lower side thereof pressing against the elastic elements 17. The side edges of the label bearing seat 2 are formed with guide flanges 20 that extend into the slanting guide slots 15 of the base 1, whereas a bottom portion of the label bearing seat 2 defines a suitable clearance with the lower base 11. Additionally, the label bearing seat 2 is centrally formed with a circular through hole 22 having guide slots or guide tracks 21 at its side edges. If necessary, a top side of the label-bearing seat 2 may have a piece of soft fabric may be adhered thereto. The receiving seat 3 has a guide track or guide groove 30 matching the circular through hole 22, with a bottom side thereof pressing a central elastic element 17' disposed in a central circular seat 16' of the lower base 11, so that the receiving seat 3 projects from the label bearing seat 2 and is slidably inserted into the through hole 22. In addition, the receiving seat 3 has a securing portion 31 for receiving a central insert hole of a compact disk or an optical disk 4.

Figure 4:
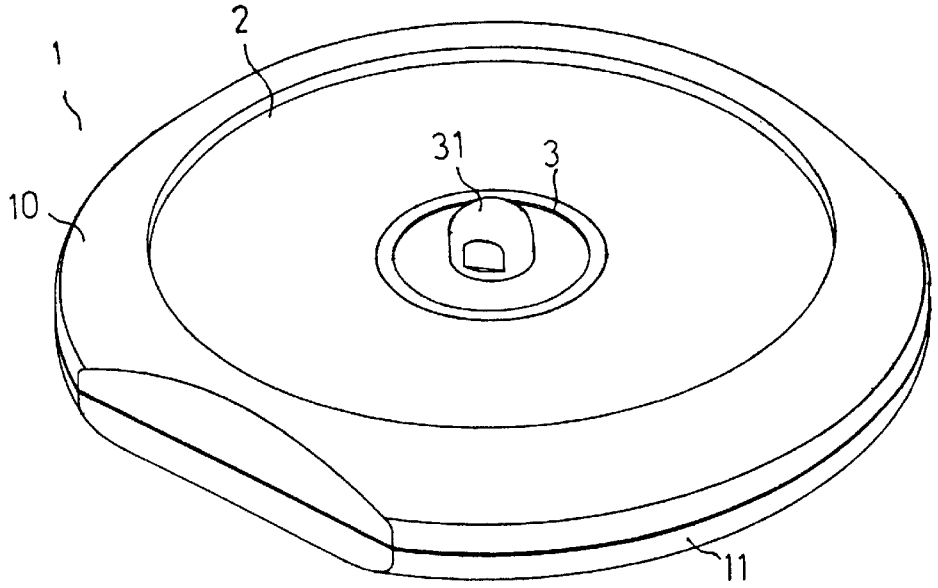
FIG. 4 is a perspective view of the present invention in a reduced size for storage and transportation purposes.

In actual use, the user may firstly use a printing machine or a printer to print an adhesive-backed annular label 5 which is placed reversely on the label-bearing seat 2. After the paper on the adhesive is peeled off, the compact or optical disk 4 is placed reversely on the securing portion 31 of the receiving seat 3. Then, by pressing the securing portion 31 of the receiving seat 3 with one hand, the receiving seat 3 is caused to slide downwardly along the guide slot or guide track 21 of the label bearing seat 2 using its guide track or guide groove 30, thereby enabling the compact or optical disk 4 to adhere to the label 5. And when being pressed further downward, the compact or optical disk 4 will make the label bearing seat 2 to utilize its guide flanges 20 to rotate along the slanting guide slots 15 of the base 1, so that the label 5 is rotatably pressed flat and can be evenly stuck to the compact or optical disk 4. There is no need to remove the compact or optical disk 4 to proceed with the time-consuming and troublesome finishing work as in the prior art. When the pressure on the receiving seat 3 is removed, the label bearing seat 2 and the receiving seat 3 will automatically reset due to the torsion and compressive elasticity of the elastic elements, facilitating removal of the compact or optical disk 4. A new annular label 5 may then be placed on the label-bearing seat 2 for the next operation. During delivery, the securing portion 31 of the receiving seat 3 may be directly pressed to cause the receiving seat to slide downwardly along the guide slot or guide track 21 of the label bearing seat 2 using its guide track or guide groove 30. When moving out the guide slot or guide track 21 of the label-bearing seat 2, the receiving seat 3 may be turned so that its rim 32 urges against the guide track or guide groove 30. And by means of the elasticity of the elastic elements 17, the receiving seat 3 may be temporarily secured in position, as shown in FIG. 4, so that the receiving seat 3 may not project excessively outward. The size of the present invention may thus be reduced to facilitate packaging and delivery. Moreover, to use the present invention, the receiving seat 3 may be pressed and turned lightly so that it is released and can project from the label-bearing seat for use.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved disk label sticking device, comprising:

a base including an upper cover and a lower base, said lower base being provided with annular seats at suitable positions for receiving elastic elements:

a label bearing seat being centrally provided with a circular through hole for receiving an annular label; and a receiving seat placed inside said circular through hole of said label bearing seat, said receiving seat having a bottom side thereof pressing against a central elastic element disposed below, and a top side provided with a securing portion for receiving a central insert hole of a compact or optical disk;

wherein said upper cover of said base is centrally formed with a through hole that has partition plates formed at side edges thereof, said lower base being provided with projecting partition pieces that define slanting guide slots with said partition plates of said upper cover, said label bearing seat being fitted in said through hole of said upper cover and having a lower side pressing against said elastic elements on said lower base, said label bearing seat further having side edges formed with guide flanges that extend into said slanting guide slots of said base, and a bottom portion that defines a suitable clearance with said lower base.

2. An improved disk label sticking device as defined in claim 1, wherein said circular through hole of said label bearing seat is provided with guide slots or guide tracks at side edges thereof, said receiving seat having a guide track or guide groove that matches and engages said circular through hole.

3. An improved disk label sticking device as defined in claim 1, wherein said label-bearing seat has a bearing face on a top side thereof, and a piece of soft fabric adhered to said bearing face.

4. An improved disk label sticking device as defined in claim 1, wherein elastic elements on said lower base have caps fitted on top thereof, said caps each having a boss thereon.

* * * * *